US005685358A

United States Patent [19]

Kawasaki et al.

[11] Patent Number: 5,685,358

[45] Date of Patent: Nov. 11, 1997

[54] METHOD FOR MELT-MOLDING GE, SI, OR GE-SI ALLOY

[75] Inventors: Koichi Kawasaki, Tokyo; Toshio Ohzono, 525-5, Minamihira, Shiga-cho, Shiga-gun, Shiga-ken 520-05, both of Japan

[73] Assignees: Tokyo Denshi Yakin Co., Ltd., Chigasaki; Toshio Ohzono, Shiga-ken, both of Japan

[21] Appl. No.: 453,005

[22] Filed: May 30, 1995

[30] Foreign Application Priority Data

May 30, 1994 [JP] Japan ..... 6-116189

[51] Int. Cl.[6] ..... B22D 17/00; B22D 27/09

[52] U.S. Cl. ..... 164/120; 164/113; 264/1.21; 264/328.2

[58] Field of Search ..... 164/120, 113, 164/312; 264/1.21, 328.2

[56] References Cited

U.S. PATENT DOCUMENTS

| | | | |
|---|---|---|---|
| 2,446,872 | 8/1948 | Ehlers | 264/328.2 X |
| 3,151,360 | 10/1964 | Jurgeleit | 164/312 X |
| 4,040,845 | 8/1977 | Richerson et al. | 106/38.9 |
| 4,606,750 | 8/1986 | Torii et al. | 65/374.13 |
| 4,614,630 | 9/1986 | Pluim, Jr. | 264/328.2 X |
| 4,733,715 | 3/1988 | Matsuzaki et al. | 164/312 X |
| 4,846,252 | 7/1989 | Sato et al. | 164/120 |

*Primary Examiner*—J. Reed Batten, Jr.

*Attorney, Agent, or Firm*—Armstrong, Westerman, Hattori, McLeland & Naughton

[57] ABSTRACT

Ge, Si or a Ge-Si alloy are melt-molded to form, for example an optical lens, by heating Ge, Si or a Ge-Si alloy to at least its melting point, and heating a molding die to a temperature above that melting point. The molten material is injected at a predetermined pressure into a cavity of the heated molding die, and then the melt is cooled at that pressure to a temperature just above a temperature at which the melt solidifies. The pressure on the melt is then decreased, and the melt is cooled to the temperature at which it solidifies. The pressure on the solidified melt is increased, and the solidified melt is cooled. After releasing the pressure on the cooled solidified melt, the optical lens, or other molded article, is removed from the die.

4 Claims, 8 Drawing Sheets

METHOD FOR MELT-MOLDING GE, SI, OR GE-SI ALLOY

BACKGROUND OF THE INVENTION

1. Field of the Invention

The present invention relates to a method for melt-molding Ge, Si, or a Ge-Si alloy, and to the optical lens for infrared rays which is molded by that method. It also relates to an infrared sensor module useful for temperature measurement, global resource observation, meteorological observation, pollution observation, crime-prevention and disaster-prevention monitoring, traffic monitoring and heat management monitoring.

2. Description of the Related Art

Alkali halides, such as NaCl or the like, and germanium (Ge), silicon (Si) or the like, are conventionally known as materials which transmit infrared rays. Of those, Ge and Si have a wide transmittance region for infrared rays and extremely high chemical stability with the highest level of mechanical strength and moisture-resistance. Accordingly, lenses made of Ge or Si impart high quality to equipment, such as infrared cameras, used for infrared imaging.

Representative characteristics of a Ge lens are described below:

(1) Since Ge has a high refractive index, about 4.0 in the wave length region of from 2 to 15 μm, a thin layer of Ge can be used to provide a lens of short focal distance.

(2) Since Ge has a narrow dispersion of refractive index over a wide wave length range, the lens does not need compensation for chromatic aberration in normal usage.

(3) Since Ge has high hardness and high mechanical strength, lenses made from Ge are adaptable for use under a wide variety of conditions.

(4) Since Ge has a wide region of wave length transmittance, lenses made of Ge are useful in the region of from 3 to 5 μm, where $CO_2$ and CO absorption bands appear, and also in the region of 8 to 10 μm, where the radiation band region of a human body and room temperature exist.

(5) Since Ge can form a large ingot, it can be used to produce a large lens.

(6) Ge can be used both as a monocrystal and as a polycrystal. While the monocrystal structure, which has no grain boundary, is accepted as superior in characteristics, such as uniformity of refractive index, the differences in characteristics between them are small and within an acceptable range.

Si has a large refractive index (about 3.42 to 3.45 in the wave length region of from 2 to 10 μm), and the characteristics of a Si lens are similar to those of a Ge lens, and provides a narrow dispersion of refractive index over a relatively wide wave length region.

The conventional method for manufacturing a Ge-lens starts with a Ge ingot, and involves block working, rough rubbing and optical polishing. A spherical lens is worked by the circular motion of an optical polishing machine; however, a non-spherical lens needs to be worked individually using a numerical control working step. For a set of lenses each having a different curved surface, performance of the set depends on the machines used and on the skill of the workers using the machines. In such a case, conventional manufacturing methods cannot be used for mass-producing of Ge lenses, production costs are higher, and Ge lenses are very expensive.

Fresnel lens production from an organic material, such as polyethylene, using injection molding has been used to prepare optical lenses for infrared rays. Several processes have been proposed for more molding inorganic material utilizing the tendency of plastic deformation of an alkali halide solid. Those processes include formation of infrared fibers, compression molding into a lens shape or hot-press molding. However, the technology of a molding method starting with a molten inorganic material is an extremely difficult technology, and only the technology for making glass articles has been successfully commercialized.

Ge and Si are materials which transmit infrared rays and have high impact resistance, and when they are removed from high temperature dies to be cooled, cracks rarely occur. These characteristics suggest that pressure molding would enable the production of molded shapes from a solid phase or molten state at an elevated temperature.

Unexamined Japanese patent publication No. 157754/1988 discloses a Ge molding method using a casting process from the molten state in a vacuum; the vacuum is effective only for deaeration. Although the process can control the die temperature, it does not lend itself to mass production of high quality lenses. The method is defective because it is incapable of controlling the pressure inside of the mold cavity making it difficult to attain a high density inside of the article being molded. A simple casting method cannot control the injection pressure of the melt into a cavity during molding, the retaining pressure on the melt during cooling, or the pressure of solidification and expansion of the material during cooling. Consequently, cracks, blisters, and depressions occur in the molded product.

Since a Ge melt is extremely reactive, the ordinary metals used to make molding dies react with Ge. Even a metal having a relatively low reactivity with Ge should be avoided to prevent even a very slight degree of contamination and to maintain high purity of the Ge melt. Accordingly, the selection of appropriate materials for making the molding die is critical. For example, when an ordinary carbon die is optically polished, the surface of the product becomes unusable because the ordinary carbon material has a highly porous structure. And a metallic die which is coated by a diamond thin film has the problem of separation between the coating layer and the metal. In addition, the metallic die is highly expensive, and abrasion of the diamond coating layer is unavoidable. A fatal defect of the diamond-coated metal die is that the thin film of diamond coating is readily destroyed by combustion in an oxygen atmosphere, and such a die is not applicable for mass-production molding of Ge lenses.

SUMMARY OF THE INVENTION

An object of the present invention is to solve the problems described above using extrusion molding, injection molding, or transfer molding processes; heating to melt a raw material consisting of Ge, Si, or a Ge-Si alloy; and controlling the pressure during molding and cooling. Thus, the present invention provides a method for melt-molding Ge, Si or a Ge-Si alloy, which is suited to the mass-production of molded shapes without inducing cracks, blisters, or depression on the surface of the molded shapes. The present invention also provides an optical lenses for infrared rays useful over a wide range of wavelengths, and infrared sensor modules containing such lenses having a wide variety of uses.

To solve the above-described problems, the present invention provides a method for melt-molding Ge, Si or a Ge-Si alloy comprising: using a molding means which enables control of the injection pressure of a melt into a molding die and of the pressure of the melt in the molding die; heating a raw material consisting of Ge, Si, or an Ge-Si alloy to its melting point or above; heating the molding die to the melting point of the raw material or above; injecting the melt into the cavity of the molding die at a predetermined pressure; cooling the melt after the injection while increasing the injection pressure and maintaining the relatively high molding pressure; decreasing the injection pressure at near the solidification point of the melt during the cooling step to maintain the low retaining pressure; reincreasing the pressure after passing the solidification point of the melt to maintain the retaining pressure at a predetermined pressure level.

As the molding means, it is preferable to inject the melt into the molding die using an extrusion molding process, an injection molding process or a transfer molding process.

As the molding die, it is preferable that the molding die be made of a high density carbon or a metal coated by a ceramic material material optically polished on the inside surface of a cavity.

The optical lens for infrared rays comprises: an optical lens which permits transmission of infrared rays therethrough and which consists of Ge, Si or a Ge-Si alloy; and which is melt-molded by the method described above.

The infrared sensor module comprises: an infrared element, which detects infrared rays, attached to a substrate having electronics parts; a casing which covers the infrared element and is fixed to the substrate; an optical lens which is mounted at an opening on the casing and is capable of transmitting infrared rays therethrough to the infrared element, wherein the optical lens consists of Ge, Si or a Ge-Si alloy; and wherein the face of infrared incidence of the optical lens is formed to have a round convex shape giving a circular arc against the infrared element; and is formed in a multi-lens set having a plurality of convex lenses integrated to the inside face thereof. The casing and the optical lens are made of Ge, Si or a Ge-Si alloy, and the casing and the optical lens are integrally molt-molded. A concave section is formed on the casing and a mating section to mate the concave section on the casing to fix the optical lens onto the casing is formed on the optical lens.

DETAILED DESCRIPTION OF THE PREFERRED EMBODIMENT

The method for melt-molding Ge, Si or a Ge-Si alloy as described above includes the steps of: heating and melting the raw material consisting of Ge, Si or a Ge-Si alloy to its melting point or above, heating the molding die to the melting point of the raw material or above; injecting the melt as a raw material into a cavity of the molding die at a predetermined pressure using the molding means. These steps allow the melt to flow into the cavity of the molding die under pressure by the injection of the raw material into the cavity of the molding die without inducing partial solidification even if the melt is cooled by the molding die. In addition, by cooling the melt after the injection while increasing the injection pressure and by maintaining the relatively high molding pressure, an increase of the density of the melt is attained. Furthermore, by decreasing the injection pressure at near the solidification point of the melt during the cooling step to maintain a low retaining pressure, the pressure of solidification and expansion of the material is absorbed to prevent generation of internal strains. Also by reincreasing the pressure after passing the solidification point of the melt to maintain the retaining pressure at a predetermined level, the density of the molded product increases without inducing cracks, blisters, or depressions. With the application of this melt-molding method, a molded product of an accurate infrared optical lens, which consists of Ge, Si or a Ge-Si alloy, can be produced during the above molding step.

By using an extrusion molding, injection molding or transfer molding process as the molding means, and by injecting the melt into the molding die, the molding process becomes simple and capable of mass-production. And since the molding pressure is increased, a molded product, such as high density infrared optical lens or the like, can be obtained.

By applying a molding die made of a high density carbon or of a metal which is coated by a ceramic material that is optically polished on the inside surface of a cavity, a highly durable, impurity free molded product, such as optical lens or the like, can be mass-produced.

Figure 4:
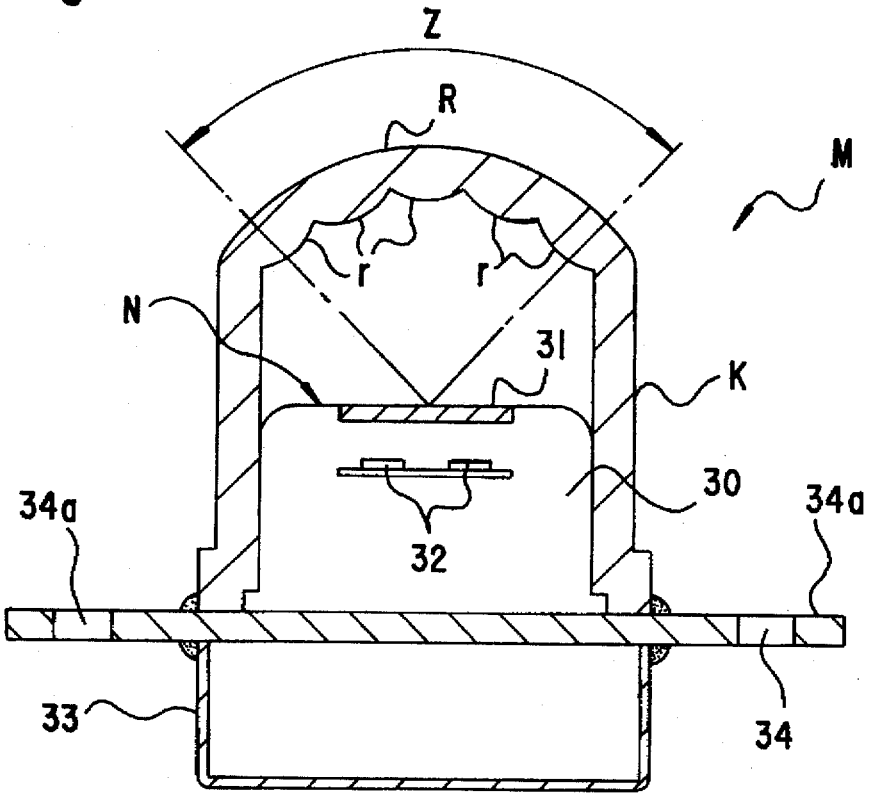
FIG. 4 is a longitudinal cross sectional view of an infrared sensor module.

The above-described melt-molding method makes it easy to form a multiple optical lens system in which the face of infrared incidence of the lens has a round convex shape with a circular are against the infrared element, and in which the optical lens is formed in a multi-lens set having a plurality of convex lenses integrated to the inside face thereof. As shown in FIG. 4, it is possible to widen the angle of incidence Z of infrared rays to exceed the angle of incidence on a flat lens. Accordingly, the entering infrared rays converge on the light-receiving section (32) in the infrared element N using the convex lens r.

Using a configuration where the casing and the optical lens consist of Ge, Si or a Ge-Si alloy, and are melt-molded integrally, no separate preparation of the casing nor assembly of the optical lens and casing are required. Since Ge, Si or the Ge-Si alloy is used as a material for a semiconductor, the prepared lens has the effect of shielding against electromagnetic waves, and is not affected by external electrical noise. Accordingly, accurate detection is secured.

In addition, by forming a concave face on the casing and by forming a mating section on the optical lens, assembly is completed readily by joining the concave face of the casing with the mating section of the optical lens, and working time is shortened compared with assembly by soldering. (Examples)

Figure 1:
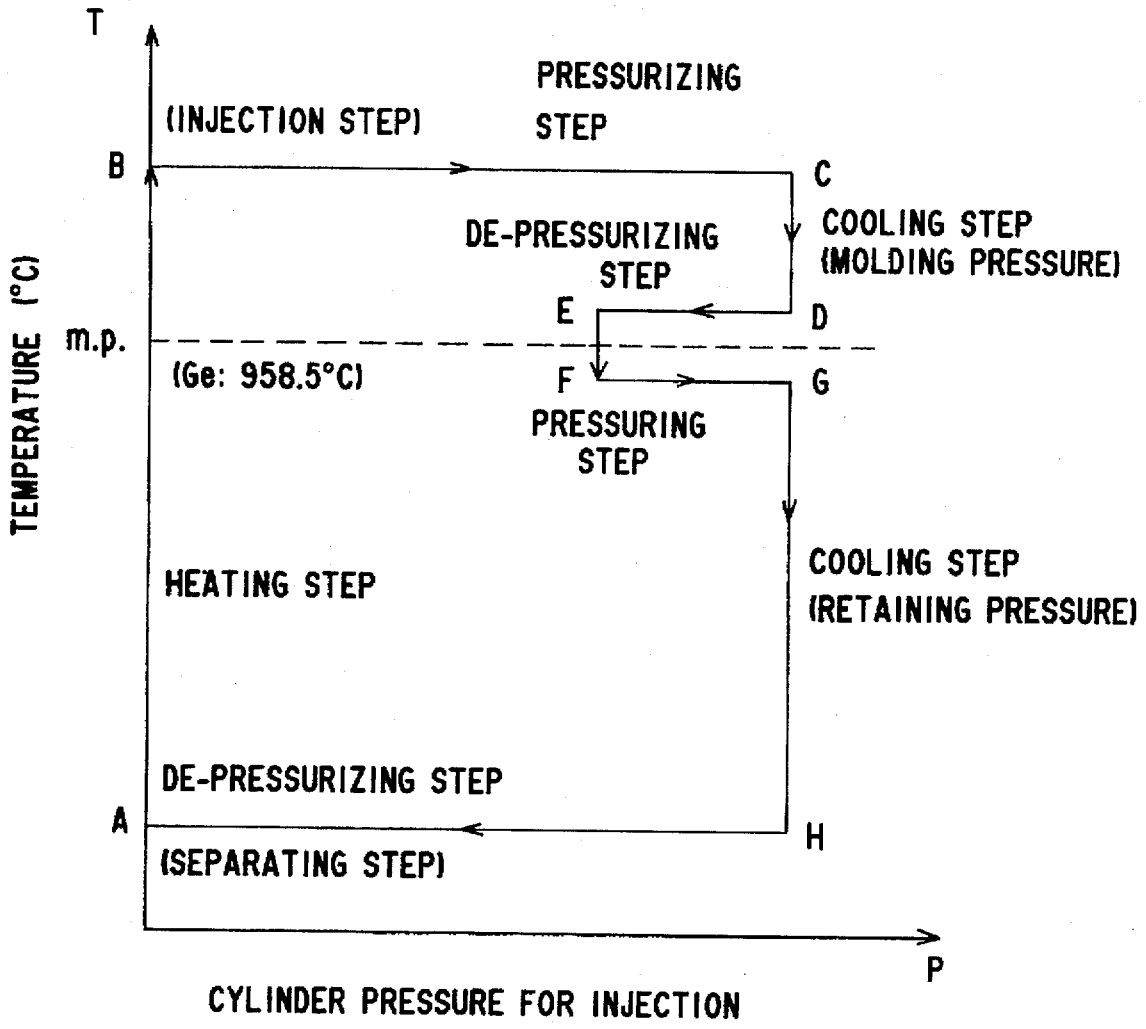
FIG. 1 is a graph of a molding cycle showing the relation between the pressure of injection cylinder and the temperature of the material in a melt-molding method.

A description is be made of the method for manufacturing an optical lens that can transmit infrared rays which comprises a raw material consisting Ge, Si or a Ge-Si alloy and which was melt-molded by a molding method. FIG. 1 is a simplified illustration of a molding cycle in the melt-molding process showing the relation between pressure (P) and temperature (T). The abscissa indicates the pressure applied to a mold clamping cylinder, and the ordinate indicates the temperature of a melt or a molding die. The molding cycle consists of: a means which enables controlling the pressure for injecting the melt into a molding die and controlling the injection pressure into the molding die and the retaining pressure on the melt; a melting means that heats the raw material consisting or Ge, Si or a Ge-Si alloy to their melting point or above to melt them (A→B, heating step); an injection means that heats the molding die to the melting point of the raw material or above, followed by injecting the melt as a raw material into the cavity of the molding die at a predetermined pressure (B→C, injection step); a cooling means that cools the melt while increasing while maintaining the relater the injection and while maintaining the relatively high molding pressure level (C→D, molding step); a first retaining means that maintains a low retaining pressure after decreasing the injection pressure during the cooling step at near the solidification point of the melt (D→E→F, depressurizing and pressure-retaining step); and a second retaining means that maintains a high retaining pressure after reincreasing the pressure when it passes the solidification point of the melt (F→G→H, pressurizing and pressure-retaining step). After cooling the melt to around room temperature, the pressure is released, and the molded product is taken out (H→A, depressurizing and separating step) to complete the molding process.

In the above-described processes, the melt of Ge, Si or the Ge-Si alloy (Ge has a melting point of 958.5° C., and Si has a melting point of 1414° C.), is injected into the molding die, which was heated at least to the melting point of the raw material using an extrusion, molding, injection, or transfer molding process for molding. The cavity of the molding die, or template, is cast to a shape corresponding to the size of optical lens, R, and on the object of use, and the inside face of the cavity is optically polished. When the raw material is brought into a molten state, and when the melt is cooled in the molding die to the solidification point of the melt, which generally coincides the melting point, or to a lower temperature, and when the solidified melt is separated from the molding die, a molded product of a precision infrared lens consisting of Ge, Si or a Ge-Si alloy having a mirror-finished optically-polished appearance which does not require future processing, is obtained.

The material for making the molding die needs to satisfy the conditions described below:

(1) Since Ge and Si are high purity semiconductor materials, any metallic contamination degrades the performance in, for example, the infrared transmittance region. Consequently, the material which contacts the melt should not react with or contaminate Ge and/or Si.

(2) The molding die should be optically polished and maintain a mirror-finished surface.

(3) The material for making the molding die have physical properties resembling the characteristic physical properties, such as thermal conductivity and coefficient of expansion which are present during the solidification of the Ge or Si melt.

A high density carbon die or a heat-resistant metal coated by a ceramic material which is optically polished on the inside surface thereof satisfies those conditions.

Regarding the molding method described above, it is preferable to use an extrusion molding or a transfer molding process, which enable a high pack-density molding, and an injection molding process, which provides a high mass-production rate as compared with a vacuum injection molding process. These preferred processes give a high pack-density molded product, and when they are used to mold lenses, the lenses have high transmittance equivalents to that of a crystalline body. Those types of molding means are equipped to control injection pressure, retaining-pressure during the die cooling step, and solidification and expansion of the material itself during the cooling step. More specifically, the control is performed in the following steps. The melt is injected into the molding die at a predetermined pressure, then the melt is cooled while increasing the injection pressure and maintaining the increased pressure at a relatively high level, the high molding pressure is maintained until the temperature of the melt becomes the solidification point thereof, then the injection pressure is decreased at around the solidification point, when the melt temperature passes the solidification point, the pressure is increased again, and the increased pressure is maintained as the retaining-pressure until the melt is cooled to a satisfactory level.

Figure 2:
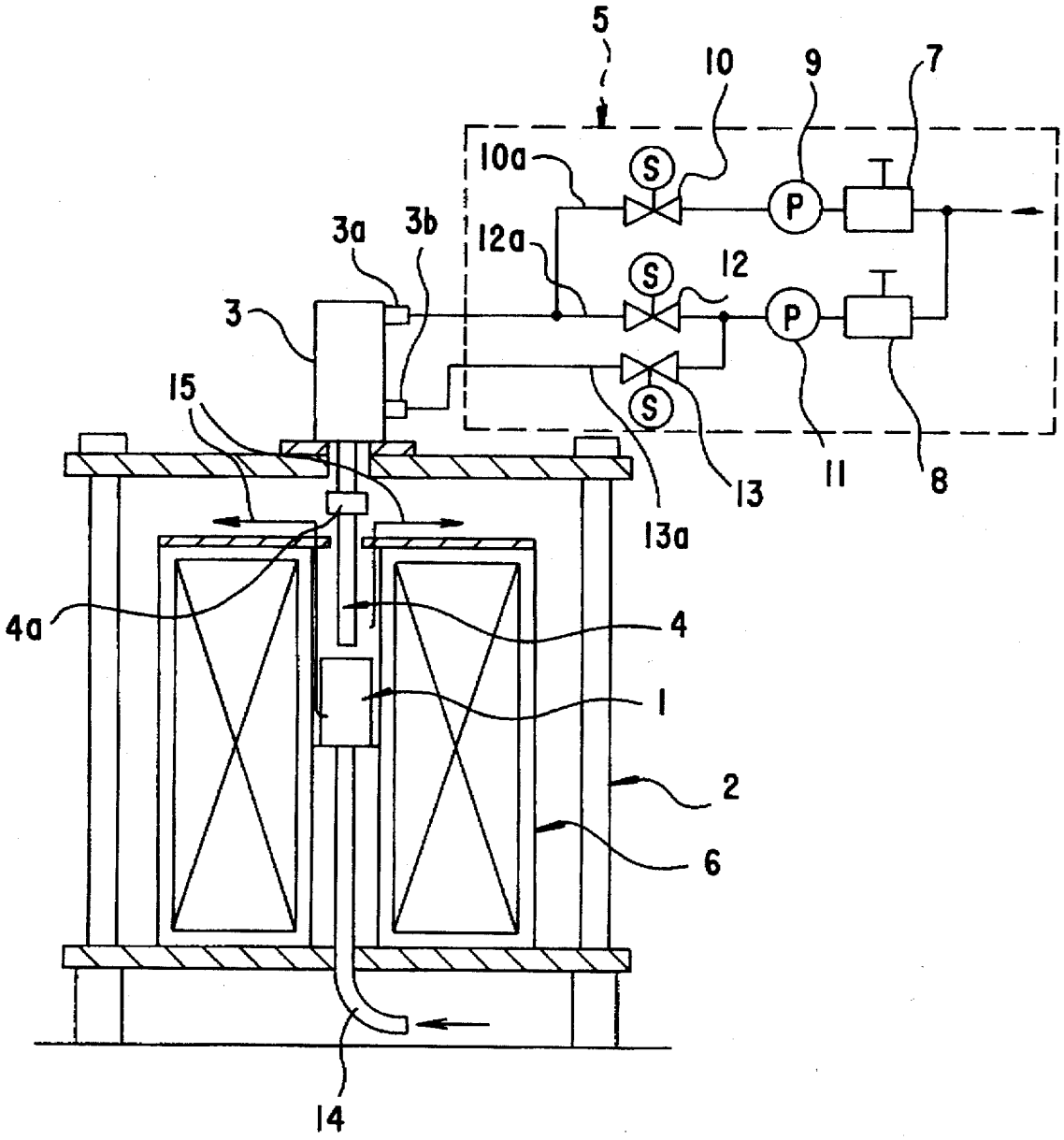
FIG. 2 is a schematic drawing of a molding machine using a transfer molding process.
Figure 3:
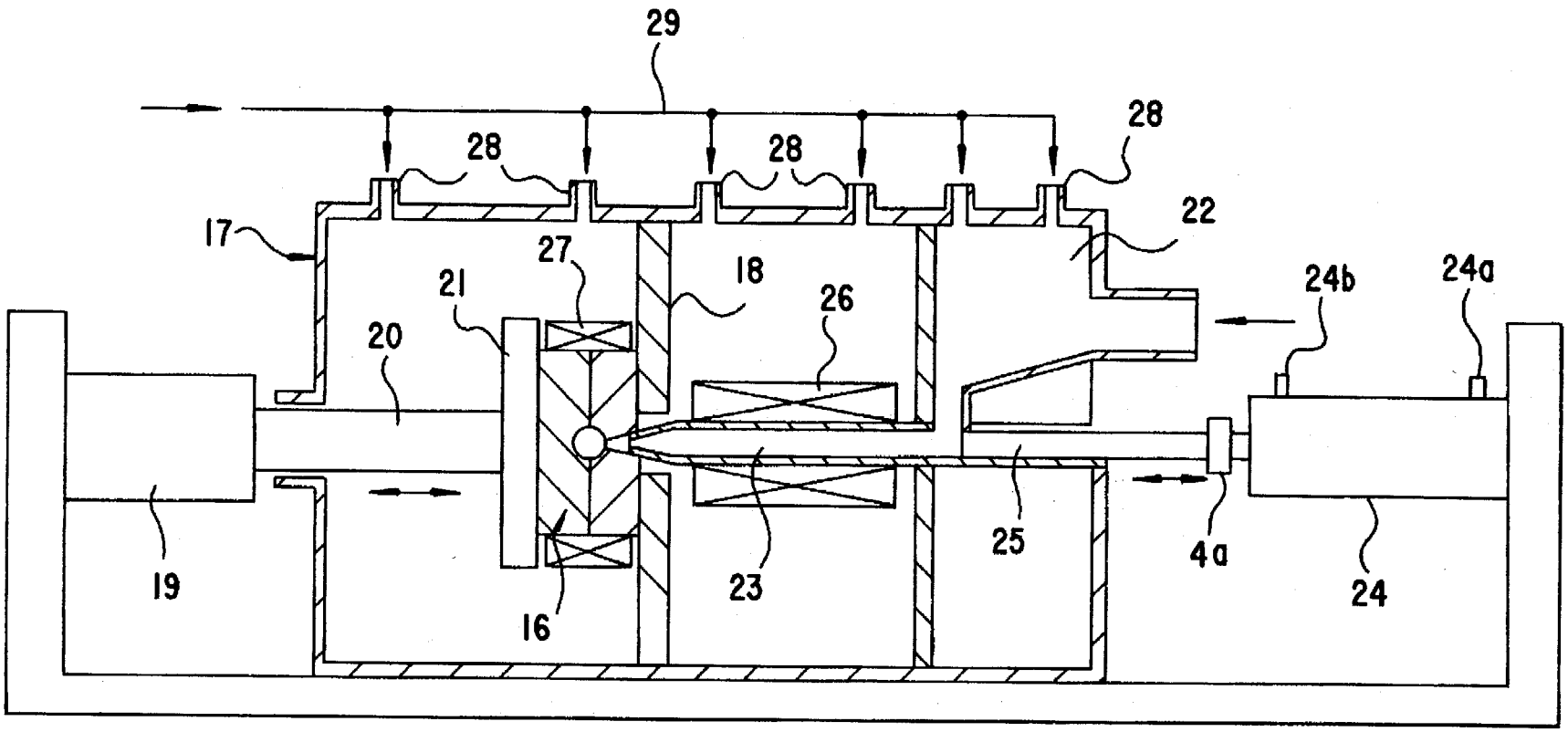
FIG. 3 is a schematic drawing of a molding machine using an injection molding process.

FIG. 2 shows a first molding machine which produces a Ge lens using a high density carbon die as the molding die employing the transfer molding process. FIG. 3 shows a second molding machine which produces a Ge lens having a specific shape using a composite molding die of heat-resistant metal coated by a ceramic material employing the injection molding process. The detailed description of these machines are given below.

The molding die (1) used in the first molding machine uses a carbon material which has been applied to a high frequency melting furnace for melting Ge. The part of the molding die (1) corresponding to the cavity is formed by a high density carbon worked-component, and the inside surface thereof is optically polished. The high density carbon material provides a high performance optically-polished surface which cannot be attained from conventional porous carbon materials. Since the whole part of the molding die (1), except the cavity, which contacts the Ge melt is made of carbon, the melt is not contaminated.

The first molding machine consists of: the molding die (1) which is positioned at the center of the retaining frame (2); an air cylinder (3) which is located at above the retaining frame (2); a plunger (4) which is mounted in the air cylinder (3) and which displaces responding to the air pressure fed to the air cylinder (3); a compressed air supply system (5) which operates the air cylinder (3); and a furnace (6) which surrounds the molding die (4) to control the temperature ranging from 950° to 1100 C. The plunger (4) is provided with a load cell (4*a*) for measuring and controlling pressure. The air cylinder (3) has the first air supply opening (3*a*) for extending the plunger and the second air supply opening (3*b*) for retracting the plunger. Compressed air is supplied from the compressed air supply system (5) to the supply openings (3*a*) and (3*b*). The compressed air supply system (5) supplies the compressed air fed from a compressor (not shown) to, dividing into two routes, the first pressure-reducing valve (7) and the second pressure-reducing valve (8), then to the electromagnetic valve (10) via the first pressure-reducing valve (7) and the pressure gauge (9), and to the electromagnetic valves (12) and (13) via the second pressure-reducing valve (8) and the pressure gauge (11), respectively. The exits of the electromagnetic valve (10) and the electromagnetic valve (12) are jointed together to connect to the first air supply opening (3*a*), while the exit of the electromagnetic valve (13) is connected to the second air supply opening (3*b*). The pressure of the air supplied to the air supply openings (3*a*) and (3*b*) is adjusted at a predetermined level by de-pressurizing the supply pressure of the compressor using the pressure-reducing valves (7) and (8). In this example, the first pressure-reducing valve (7) is set at a high pressure level, and the second pressure-reducing valve (8) is set at a low pressure level. The pipes at the exit of the electromagnetic valves (10), (12) and (13) are denoted as the lines (10*a*), (12*a*) and (13*a*), respectively.

The process for manufacturing a Ge infrared lens using the first molding machine is the following. The raw material Ge powder having an approximate particle size of 2 to 3 mmΦ. is filled in the molding die (1). A reducing gas such as a forming gas is introduced to the molding die (1) through the gas supply pipe (14) connected to the bottom of the molding die (1) to replace moisture and other gas components in the packed raw material powder bed. Compressed air is supplied by opening the electromagnetic valve (13) to the second air supply opening (3*b*) of the air cylinder (3) through the line (13*a*). The furnace (6) is operated under the condition that the plunger (4) is positioned at the ascended position to heat the raw material powder and the molding die (1). At that moment, the temperature of the molding die (1) and inside atmosphere of the furnace (6) is controlled while monitoring the temperature by the temperature monitor (15). When the temperature monitor (15) detects the temperature of the molding die (1) at or above the melting point of the raw material, the electromagnetic valve (10) is opened to introduce the high pressure compressed air from the line (10*a*) to the first air supply opening (3*a*) of the air cylinder (3), and the electromagnetic valve (13) is closed to descend the plunger (4) to apply pressure to the molding die (1). Thus, the melt as a raw material is pressurized in the cavity to retain one pressure. Only retaining pressure is the molding pressure. As next step, the temperature of the furnace (6) is decreased, or the heating of the furnace (6) is stopped, or a forced air cooling is applied to cool the molding die (1). The speed of cooling is set to an optimum level depending on the thickness and the heat capacity of the molded shape. When the cooling action is continued to lower the temperature of the raw material to near the solidification point thereof, the electromagnetic valve (10) is closed, and the electromagnetic valve (12) is opened to supply a low pressure compressed air from the line (12*a*) to the first air supply opening (3*a*). Then the pressure applied to the molding die (1) is lowered by the plunger (4), and the retaining pressure is maintained. When the temperature of the molding die (1) is decreased to below the solidification point of the melt, the electromagnetic valve (12) is closed, and the electromagnetic valve (10) is opened to supply high pressure compressed air from the line (10*a*) to the first air supply opening (3*a*). Then the pressure applied to the molding die (1) is increased by the plunger (4), and the retaining pressure is maintained. For the pressure-retaining step, the basic controlling conditions are to maintain the injection pressure at a high level and to maintain sufficient retaining pressure level luring the cooling step.

The second molding machine is described referring to FIG. 3. The molding die (16) of the molding machine consists of heat-resistant metal (SK steel, Hastelloy, etc.), and the inside part contacting the raw material is coated by ceramic material. Regarding the structure of the molding machine, a die of the molding machine (16) is fixed on the fixed plate (18) which is located vertically within the housing (17), and the other die of the molding machine (16) is fixed on the moving head (21) which is attached to the end of the mold clamping ram (20) of the mold clamping cylinder (19). In addition, the raw material retaining section (22) and the injection cylinder (23) connecting to the raw material retaining section (22) are horizontally installed in the housing (17). The injection cylinder (23) receives the inserting piston (25) of the injection/pressure-retaining cylinder (25) driven by compressed air or the like. The nozzle section at the tip of the injection cylinder (23) connects the molding machine (16)passing through the fixed plate (18). A horizontal furnace (26) is located at around the injection cylinder (23) to melt the raw material. A heater (27) is located at around the molding machine (16) to control the temperature of the die. At the top of the housing (17), there located a section containing the molding die (16), a raw material retaining section (22), and a section containing the horizontal furnace (26), each of which sections has the gas supply openings (28). The forming gas is supplied from the gas supply system (29) to each section inside of the housing (17). The inside surface of the injection cylinder (23) for pelting the raw material is also coated by a ceramic material. To the first air supply opening (24*a*) and the second air supply opening (24*b*) of the injection/pressure-retaining cylinder (24), a compressed air supply system (not shown; similar type with that described above) is connected to adjust the pressure applied to the molding die (16) using the piston (25) by changing the pressure and flow passage of the compressed air for the injection/pressure-retaining cylinder (24).

The procedure for manufacturing a Ge lens having a special shape using the second molding machine is as follows. The particulate Ge raw material powder is filled into the raw material retaining section (22). The forming gas is supplied from the top of the raw material retaining section (22) to refine the surface of the raw material particles. A pressurized fluid is fed to the mold clamping cylinder (19) to move forward the mold clamping ram (20) to close the molding die (16). Then, in a state that the piston (25) is retracted, the raw material is introduced into the injection cylinder (23). The piston (25) is moved forward to transfer the raw material powder to the section of the horizontal furnace (26) and to heat the raw material to melt them. On the other hand, the molding die (16) is heated by the surrounding heater (27) to a temperature of melting point of the raw material or above. The melt is injected into the cavity of the molding die (16). The piston (25) is provided with a load cell to monitor the pressure change. The heater (27) controls the molding and cooling of the melt in the cavity of the molding die (16) at a necessary retaining pressure and temperature or one die. While applying one retaining pressure, the melt is cooled to mold. Then, the mold clamping ram (20) is retracted, and the molded product is separated from the molding die (16) to take it out. The detail of the control of pressure and temperature is not described here because it is the same as described above.

The molding die (16) may be made of a high density carbon to produce an optical lens by injection molding of molten Si into the molding die, or may be made of a molding die made of a metal coated with a ceramic material to produce an optical lens made from Ge-Si alloy.

Figure 5:
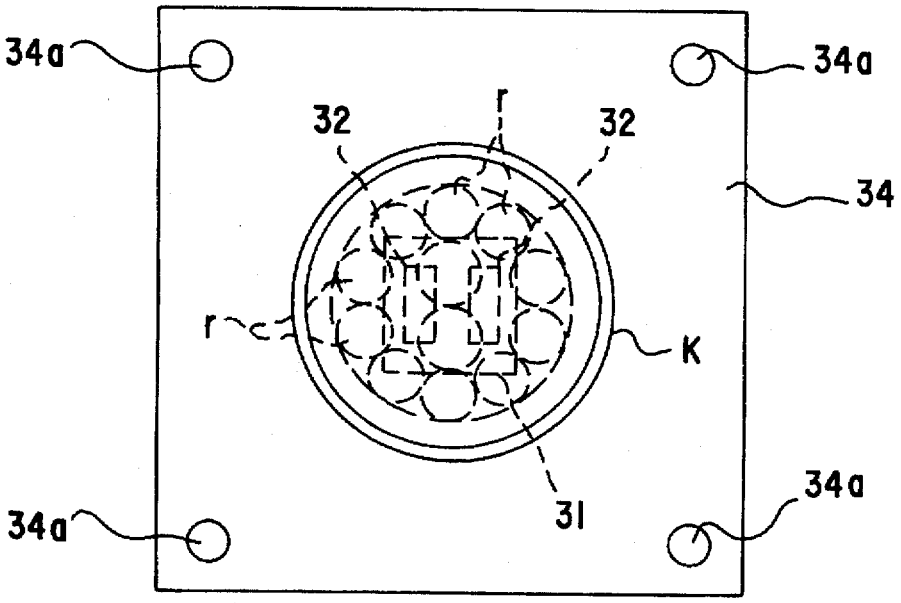
FIG. 5 is a plan view of the infrared sensor module.

FIGS. 4 and FIG. 5 show an infrared sensor module M of the present invention, which module uses an optical lens R prepared by the above-described molding method. The infrared sensor module M consists of an infrared element N which detects infrared rays, a casing K to cover the infrared element N, and an optical lens R which is located at the opening on the casing K. The infrared sensor module M detects the infrared rays emitted from human body using the infrared element N.

The infrared element N consists of a metallic package (30) having a function of hermetic seal and electromagnetic shield, an optical filter (31) as the infrared transmittance window provided at the opening of the -metallic package (30), and a pair of light-receiving sections (32), (32) to receive the infrared rays transmitted through the optical filter (31). The infrared element N is attached to the printed circuit board (34) having electronic devices. The casing K is fixed on the printed circuit board (34) by soldering. The hole (34*a*) is opened on the printed circuit board (34) for receiving a set screw. The casing (33) covers the electronic devices which protrude downward from the bottom edge of the printed circuit board (34).

A pair of light-receiving sections (32), (32) is connected each other in such a manner that the direction of polarization processing is inverse each other. Although both of the light-receiving sections (32), (32) function against the incidence infrared rays transmitting through the optical filter (31), they do not generate light for temperature change in the vicinity of the sensor and disturbance such as mechanical impact, which give an effect at the same phase of them.

As shown in FIGS. 4 and 5, the optical lens R comprises a plurality of convex lenses r which protrude inward from the one side of the inner face thereof to form an integrated multi-lens structure, while the infrared incidence face is formed to have a round convex shape drawing a circular are against the infrared element N. This configuration permits widening the angle of incidence Z of infrared rays compared to that with a flat face lens, and focuses the entering infrared rays to the plurality of convex lenses r and onto the light-receiving sections (32), (32) of the infrared element N.

The casing K is formed of a Ge raw material which is the same as that used to prepare the optical lens R. The casing K is integrally melt-molded with the optical lens R by the molding process described earlier. The casing K itself has a shielding effect against electromagnetic waves. Thus, assembling the optical lens R with a separately prepared casing is eliminated.

As described earlier, the outer surface of the optical lens R is mirror-finished in the cavity of the molding die and optically polished, and it is not necessary to further work the finished surface. In addition, both outside and inside surfaces of the optical lens R are covered with a transparent thin film of infrared coating. The outside surface of the lens is surface-treated with an infrared multi-layer coating for the transmittance region to function as a 6 micron cut-on filter, and the inside surface of the lens is surface-treated with a transparent thin film of a single layer to function as a non-reflective face.

Figure 6:
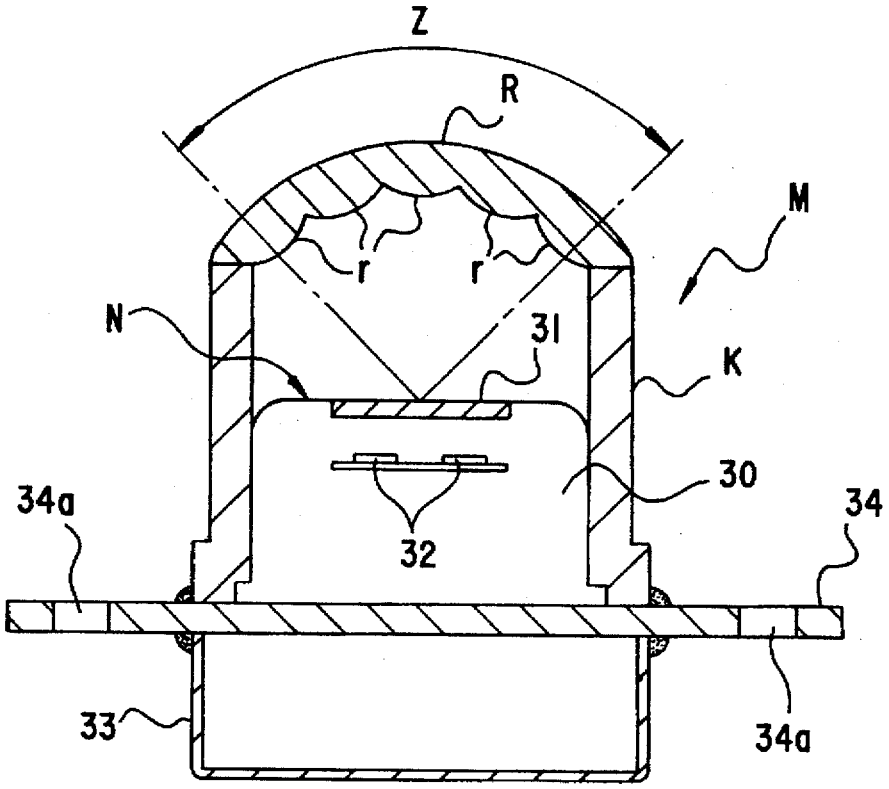
FIG. 6 is a longitudinal cross sectional view of an infrared sensor module of another example.
Figure 7:
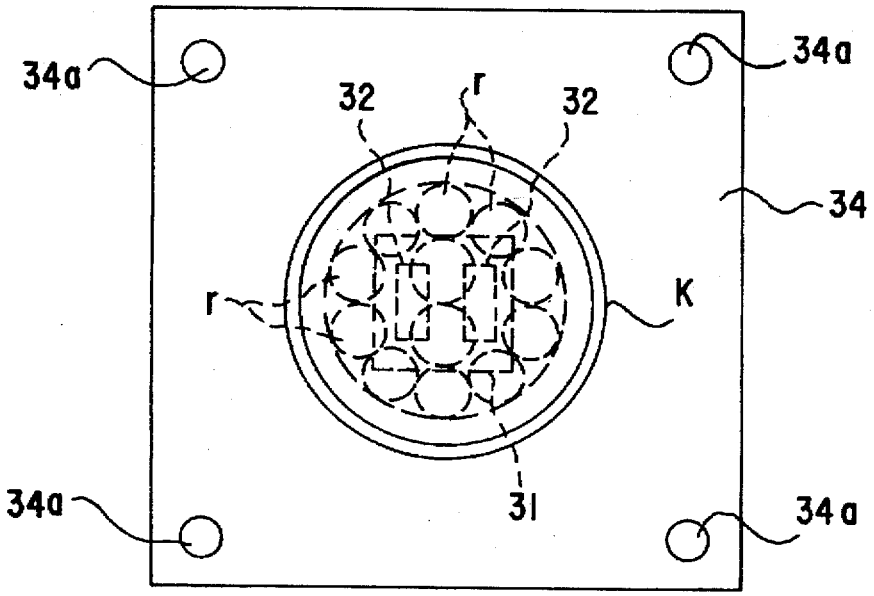
FIG. 7 is a plan view of the infrared sensor module of another example.

In addition to the integrated melt-molding of the casing K and the optical lens R, a separately formed metallic casing K may be joined with the optical lens R by soldering as shown in FIGS. 6 and 7. Assembly by soldering has the advantage that the inside face of the optical lens R is more readily coated as compared with the coating of an optical lens R which is integrated with the casing K by the melt-molding process.

Figure 8:
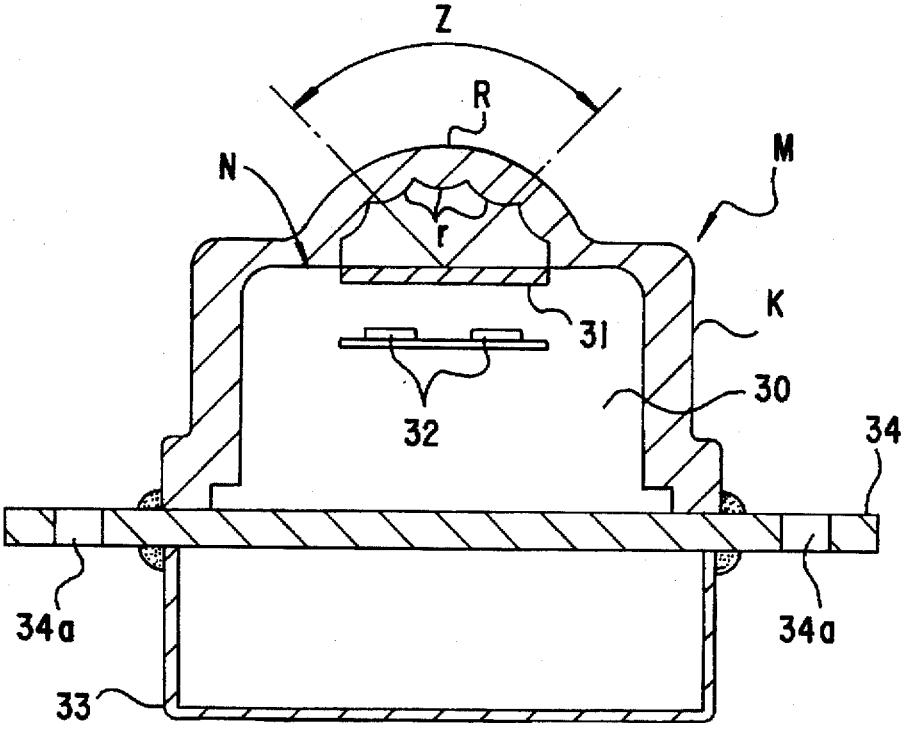
FIG. 8 is a longitudinal cross sectional view of an infrared sensor module of another example.
Figure 9:
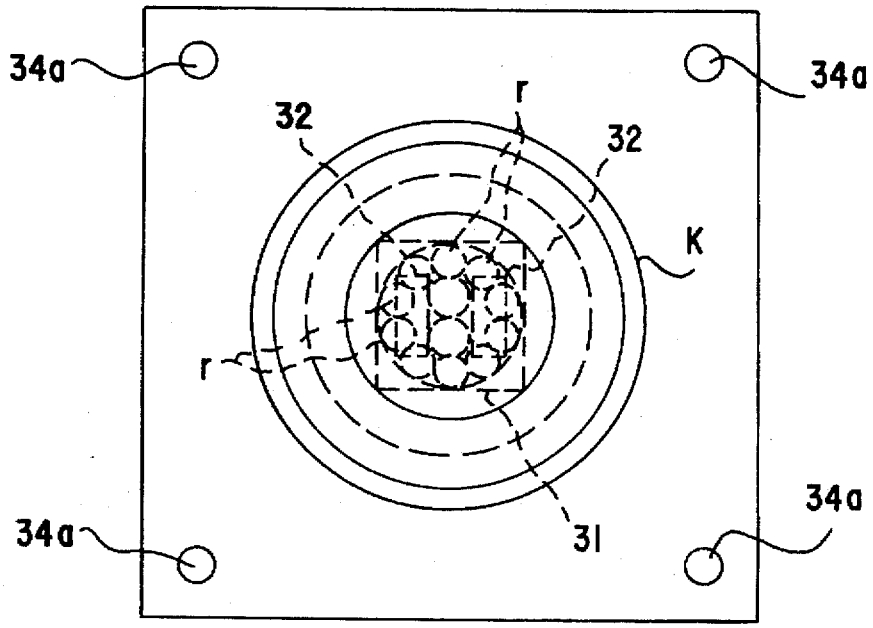
FIG. 9 is a plan view of the infrared sensor module of another example.

As shown in FIGS. 8 and 9, the optical lens R may be of any convenient size and may be of the same width as the width of the optical filter (31) of the infrared element N to minimize the size of the infrared sensor module M. The inside face of the optical lens R may be provided with a plurality of convex faces r, or a portion of the inside face or a portion of the outside face, or the whole area of the outside face may be provided with a plurality of convex faces r. Alternately, the optical lens R itself may be formed as Fresnel lens. In this manner, the shape of the optical lens R is freely selectable.

Figure 10:
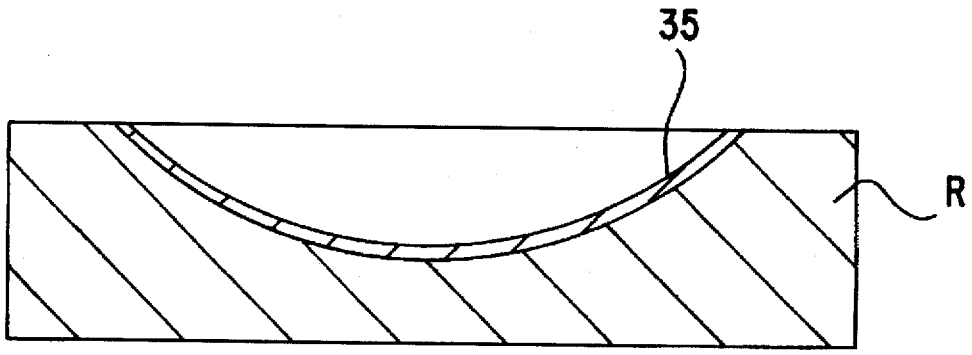
FIG. 10 is a cross sectional view of an optical lens.

FIG. 10 shows a concave lens which was prepared by the above-described molding method. On the whole surface of the infrared incidence side of the concave lens R, a metallic layer (35) which is coated with a vapor-deposited metal, such as Al or Au, to function as a condenser lens.

Figure 11:
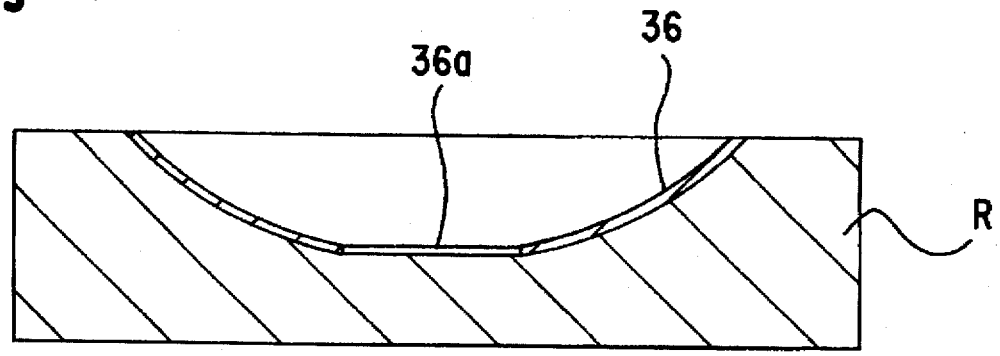
FIG. 11 is a cross sectional view of an optical lens of another example.

The concave lens shown in FIG. 11 has the coating of a metal layer (36) which consists of a vapor-deposited metal, such as Al or Au, at only the part excluding the central portion on the infrared incidence surface of the concave lens R. The part of the metallic layer (36) condenses the infrared rays, while the part (36*a*) where no metallic layer (36) is deposited permits the infrared rays to pass therethrough to and functions as an interference filter.

Figure 12:
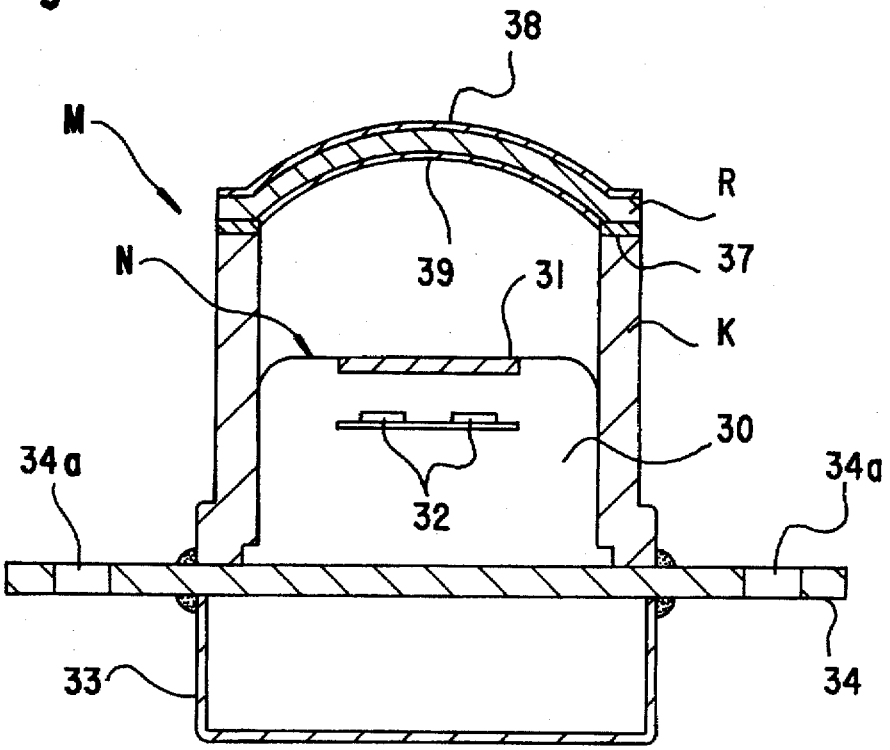
FIG. 12 is a longitudinal cross sectional view of an infrared sensor module of another example.

Another example of the lens R is shown in FIG. 12. The infrared element N, which detects the infrared, is attached to the printed circuit board (34) which has electronic parts thereon. The metallic casing K for covering the infrared element N is fixed to the printed circuit board (34) by soldering. The lens R, which transmits infrared rays to the infrared element N, is treated by coating, followed by joining the lens R to the opening on the casing K. The coated section (37), which was treated by Ni electroless coating or by electrolytic coating, is subjected to rinsing and drying, then to joining by a low-melting point metal or a solder. The reference numerals appearing in FIG. 12 and not described here designate the same components appearing in the descriptions given above.

Both the front and rear sides of the lens R are coated for preventing reflection. These coating layers (38) and (39) function as interference filters which permit only a specified wave length to pass therethrough.

As for the infrared sensor module M, various types of detectors can be utilized including a thermocouple, bolometer, photon detector or any type of detector which can detect infrared rays.

Figure 13:
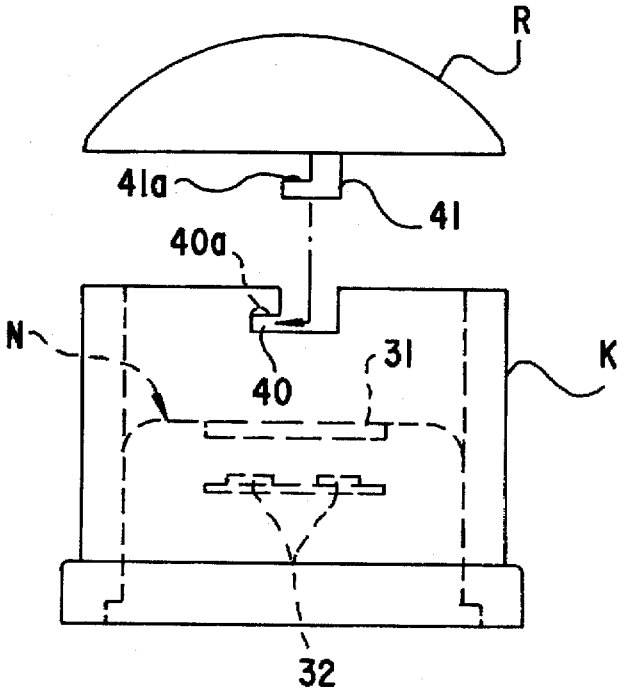
FIG. 13 is a side view showing the assembled structure of an optical lens and a casing.

A method for assembling the optical lens R and the casing K is illustrated in FIG. 13. The casing K is provided with a guide groove (40) having a near-reverse-L shape as viewed from the side. A concave section (40*a*) as the mating-target section of the casing K is formed at the end of the guide groove (40). A mating convex section (41*a*) is projected at the lower end of the optical lens R to the mating piece (41) having a near-reverse-L shape, as viewed from the side, which acts to fix the optical lens R onto the casing K by mating with the groove (40) of the casing K. When the mating piece (41) of the optical lens R is inserted into the groove (40) of the casing K from above, and when the optical lens R is rotated clockwise, the optical lens R is fixed to the casing K by mating the mating convex section (41*a*) of the mating piece (41) to the concave section (41*a*) of the groove section (40). By rotating the optical lens R counterclockwise, the mating is released, and the optical lens R is detached from the casing K. FIG. 13 shows only one set of the mating section (41*a*) and the concave (40*a*). However, two or more sets can be utilized. The outside surface of the casing K may be mirror-finished or may be coated. And by fixing the lower end of the casing K onto the printed circuit board (34) by soldering, as described above, the shielding effect at the soldered part does not degrade.

The casing K may be made of a Si or a Ge-Si alloy, as well as Ge. The metallic package (30) of the infrared element N may be made from Ge, Si or a Ge-Si alloy, and the optical filter (31) of the infrared element N may be made from Ge, Si or a Ge-Si alloy. By fixing the optical filter (31) to the optical lens R of the present invention, the easing K which covers the infrared element N can be eliminated.

(Effect of the Invention)

Melt-molding of a raw material consisting of Ge, Si or a Ge-Si alloy is applicable as the molding method. Accordingly, generation of internal strain is prevented by absorbing the pressure induced during solidification and expansion of the material, a high dimensional accuracy is assured, no cracks, no blisters, or depressions occur on the molded products, and disadvantages in the manufacturing process triggered by, for example, dispersion of molded products are avoided. In addition, compared with conventional polishing using an optical polishing machine, the melt-molding process more effectively utilizes the expensive Ge, Si or a Ge-Si alloy raw material providing molded products, such as optical lenses for infrared rays, which can be used in lighting equipment and in proximity to electric heaters. When a lens having a short focal distance is produced by the molding method of the present invention, the resultant lens exhibits only a small deformation or aberration. Thus, in addition to improving the transmittance of infrared rays, the lens may be made small in size, and it improves the signal to noise ratio in a signal processing system reducing the possibility of malfunctioning of the system that might be induced by such noise.

By forming the optical lens to have the face of infrared incidence in a shape of circular convex are against the infrared element, the angle of incidence is widened compared with that of a flat face lens, and the inside integrated face of convex lens enhances the convergence of infrared rays onto the light-receiving section. As a result, the optical lens provides an infrared sensor module that enables widening the range of detection while avoiding possible errors in detection caused by deformation or the like.

Using a casing that is made from Ge, Si or a Ge-Si alloy, and is integrally melt-molded with the optical lens in the molding process, the work of assembly and of production is simplified. By forming a concave section on the casing and by forming a mating section on the optical lens for fixing the optical lens to the casing through the mating action with the concave section on the casing, assembly becomes easier and quicker compared with the case of joining two separately prepared components by soldering. In addition, since the casing itself has an electromagnetic shielding effect, it provides an infrared sensor module having a high reliability for performing accurate detection without utilizing a separate electromagnetic shield.

What is claimed is:

1. A method for melt-molding Ge, Si or a Ge-Si alloy, which comprises:

heating a material consisting of Ge, Si or a Ge-Si alloy to at least the melting point of the material;

heating a molding die to a temperature above the melting point of the material;

injecting the molten material at a predetermined pressure into a cavity of the heated molding die;

cooling the molten material at the predetermined pressure in the cavity of the heated molding die to a temperature just above the temperature at which the material solidifies;

decreasing the pressure on the molten material in the cavity of the molding die and cooling the molten material to the temperature at which the material solidifies;

increasing the pressure on the solidified material in the cavity of the molding die to the predetermined pressure and cooling the solidified material; and releasing the pressure on the solidified material and separating the solidified material from the molding die.

2. A method according to claim 1, wherein the melt-molding is by extrusion molding, injection molding or transfer molding.

3. A method according to claim 1, wherein the molding die is made of a high density carbon material optically polished on an inside surface of the die cavity.

4. A method according to claim 1, wherein the molding die is made of a metal coated with a ceramic material optically polished on an inside surface of the die cavity.

* * * * *